US006004068A

United States Patent [19]

Hosley

[11] Patent Number: 6,004,068

[45] Date of Patent: Dec. 21, 1999

[54] METHOD AND APPARATUS FOR FORMING A TRENCH OR CATCH BASIN VOID

[76] Inventor: David Hosley, 8704 Hwy 301 N, Tampa, Fla. 33637

[21] Appl. No.: 09/095,380

[22] Filed: Jun. 10, 1998

Related U.S. Application Data

[63] Continuation-in-part of application No. 09/004,380, Jan. 1, 1998.

[51] Int. Cl.[6] ..... E02B 5/00

[52] U.S. Cl. ..... 405/118; 404/2; 249/10

[58] Field of Search ..... 405/36, 43, 46, 405/50, 118, 119; 249/10, 11, 12, 1, 4; 52/323, 745.09, 745.12, 576, 577; 404/2, 3, 4

[56] References Cited

U.S. PATENT DOCUMENTS

| | | | |
|---|---|---|---|
| 5,000,621 | 3/1991 | Beamer | 405/118 |
| 5,066,165 | 11/1991 | Wofford et al. | 405/118 |
| 5,281,051 | 1/1994 | Stegall | 405/118 |
| 5,399,047 | 3/1995 | Stegall | 405/118 |
| 5,538,361 | 7/1996 | Beamer | 405/118 |
| 5,573,350 | 11/1996 | Stegall | 405/118 |
| 5,782,049 | 7/1998 | Gates et al. | 249/10 |
| 5,799,455 | 9/1998 | Gates et al. | 52/323 |

*Primary Examiner*—David Bagnell
*Assistant Examiner*—Frederick Lagman

[57] ABSTRACT

A method and apparatus for forming a trench or catch basin void with removable cardboard components that fold up to create a three dimensional trench void form, and pair of elongated frame members to define a support surface for a trench cover is disclosed according to the present invention. The removable cardboard form includes a rectangular shape with outwardly extending edges running longitudinally along the top surface. A pair of elongated frame members lay in a coplanar, spaced relationship to the side and bottom of the outward extended top edges of the predetermined form. The frames are used to define a surface to support the trench covers. A pair of U shaped support legs are joined at the ends to the frame members with nuts in order to maintain clearance for total encasement and adjust the top of the form to the desired finish elevation. Another preferred embodiment utilizes a rectangular rail for creating a drain support in a finished catch basin.

14 Claims, 9 Drawing Sheets

LOWER FORM - SIDE VIEW

LOWER FORM - FILLER PANELS

TOP VIEW UNFOLDED

FIG.- 6B TOP VIEW FOLDED

TOP VIEW

EXPLODED VIEW

METHOD AND APPARATUS FOR FORMING A TRENCH OR CATCH BASIN VOID

CROSS-REFERENCE TO RELATED APPLICATION

The instant application is a Continuation-in-part of Application Ser. No. 09/004,380 filed Jan. 1, 1998.

BACKGROUND OF THE INVENTION

This invention relates generally to the field of construction, and more particularly to a method and apparatus for forming a trench or catch basin void.

Historically, mankind has been using trench drains since the dawn of time. The Romans used them to deliver water to cities for drinking and bathing and to farm lands for irrigation. Trench drains have also been used to collect runoff and channel it to other locations preventing flooding. In recent times trench drains have been used as secondary containment systems preventing chemical spills from escaping into the environment.

Most trench drains are formed in place using plywood to make both a bottom form, and side forms, which must be removed after the concrete has set. It is time consuming and requires a carpenter to build the forms. This type of trench also requires a waterstop in the keyway joint where the walls and floor of the trench join. Styrofoam forms are the latest products to enter the market. They are comprised of solid foam that is cut into the shape of a trench drain, use elongated steel members and supports to hold them prior to concrete encasement. Such a system was disclosed in U.S. Pat. No. 5,478,169. They are comprised of solid foam forms that are cut to the shape of the basin desired, and use steel frames and supports to suspend them prior to concrete encasement. Foam forms are expensive to ship due to large bulk and no weight. They are susceptible to damage in transit. Compared to wood forming techniques they are expensive. Styrofoam is flammable and can give off toxic gases. It breaks up into small light pieces during deformation and can be scattered by the lightest wind, littering the landscape. Landfills do not like to take styrofoam because it will not decompose and takes up excessive space.

Historically most catch basins are made of precast concrete, which are extremely bulky and require heavy equipment to lower them into place. The outlet holes must be cased in exact locations to match the elevations required on each specific jobsite, and the size of pipe specified. Because of their weights, they can be dangerous during placement and can cause serious injury or death. They must be transported by tractor trailers to the jobsites because of their bulk. Another method is to form the catch basin in place using plywood to make both a bottom form and side forms. This requires a carpenter to cut and build the forms. This is both time consuming and costly in labor and materials. Similar use of styrofoam as described above has been employed to form catch basins as well.

SUMMARY OF THE INVENTION

The primary object of the invention is to provide a forming system that is less expensive to construct.

Another object of the invention is to provide a form that can be assembled by unskilled labor with simple hand tools.

Another object of the invention is to provide a form that costs less to ship.

Yet another object of the invention is to provide a form that is easier to deform.

A further object of the invention is to provide a form that is recyclable and biodegradable.

Still yet another object of the invention is to provide a form that is collapsible and easily stored and/or shipped compactly.

Other objects and advantages of the present invention will become apparent from the following descriptions, taken in connection with the accompanying drawings, wherein, by way of illustration and example, embodiments of the present invention are disclosed.

In accordance with a preferred embodiment of the invention, there is disclosed a trench forming assembly with removable cardboard of predetermined shape that folds up to create a three dimensional trench void form. The disposable elongated form body is comprised of a top, bottom and opposed side surfaces. Preferably the top defines a complex shape with outwardly extending edges running longitudinally along the top surface. A pair of elongated frame members are used for defining a surface to support trench covers, and lay in a coplanar, spaced relationship to the side and bottom of the outward extended top edges of the form. The trench forming assembly further includes at least two U shaped support legs that are joined at the ends to the frame members, maintaining clearance for total encasement of the hardening agent on the sides and bottom of the form. Once the hardening agent is set, the form is removed exposing a trench void with recessed support seats for grate covers.

The form for forming a trench void has a first foldable member folded along pre-determined scoring into a rectangular box for insertion into a void, a second foldable member folded along pre-determined scoring attached to said first member on the top side of said rectangular box, rails placed in close proximity to said second member having attachment points for a plurality of U-shaped brackets, and a plurality of U-shaped brackets attached to said rails wherein said brackets provide support for said first and second member while placed in the void.

In accordance with another preferred embodiment of the invention, there is disclosed a catch basin forming assembly with removable cardboard of predetermined shape that folds up to create a three dimensional basin void form. The disposable form body is comprised of a top, bottom and opposed side surfaces. Preferably the top defines a complex shape with outwardly extending edges running longitudinally along all four sides of the top surface. An elongated frame member is used to define a surface to support a basin cover, and lay in a coplanar, spaced relationship to the side and bottom of the outward extended top edges of the form. The basin forming assembly further includes at least four L shaped support legs that are joined to the frame member, maintaining clearance for total encasement of the hardening agent on the sides and bottom of the form. Once the hardening agent is set, the form is removed exposing a Catch basin void with recessed support seats for the grate cover.

The catch basin form has a first foldable member folded along pre-determined scoring into a rectangular box for insertion into a void, a four-sided rail with attachment points for a plurality of U-shaped bracket placed on top of the first member that conforms substantially to the outline of the open side of the rectangular box, a second foldable member folded along pre-determined scoring placed on top of said rail, a plurality of U-shaped brackets attached to the rail wherein said brackets provide support for the first and second members while placed in the void.

In accordance with another preferred embodiment of the invention, there is disclosed a method for forming a trench void comprising placing a first foldable member folded along pre-determined scoring into a rectangular box into a void, attaching a second foldable member folded along pre-determined scoring to the top of the first member, placing rails in close proximity to the second member having attachment points for a plurality of U-shaped brackets, and attaching a plurality of U-shaped brackets to the rails to provide support for the first and second members while placed in the void.

In accordance with another preferred embodiment of the invention, there is disclosed a method for forming a catch basin void comprising placing into a void a first foldable member folded along pre-determined scoring into a rectangular box, placing on top of the first member a four-sided rail that conforms substantially to the outline of the open side of the rectangular box having attachment points for a plurality of U-shaped brackets, attaching a second foldable member folded along pre-determined scoring on top of said rail forming the sixth side of the rectangular box, attaching a plurality of U-shaped brackets to the rail wherein the brackets provide support for the first and second members while placed in the void.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
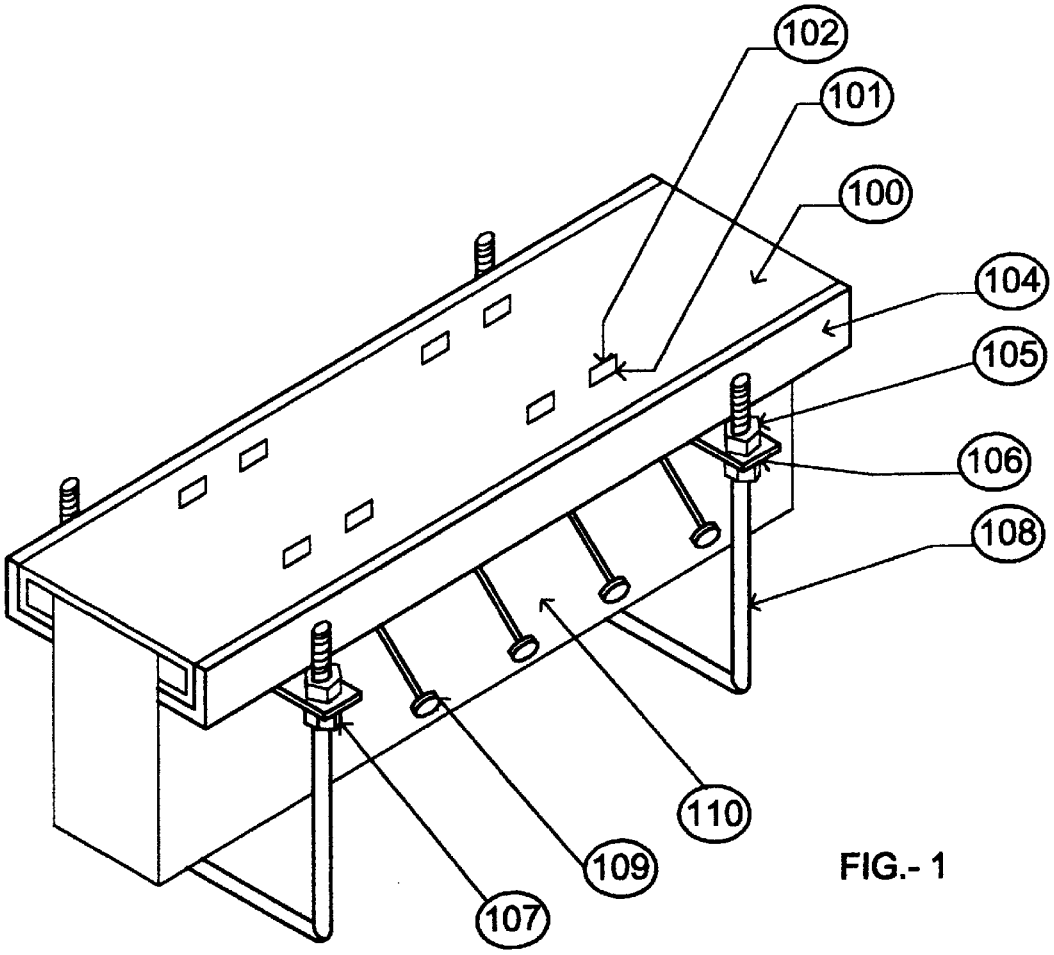
FIG. 1 is a perspective view of the trench form components in accordance with the invention.

Turning now to FIG. 1 there is shown a view of a trench drain form in accordance with the invention. The trench drain formed is composed of two foldable members 100 and 110 that are attached to each other by reciprocal tabs 101 and slots 102. You will note that the trench form has the standard shape desired, and the elongated rails 104 that are commonly utilized to provide a finished seat for trench covers in the industry. Of course the size and shape of the form can be varied to virtually any configuration using different foldable members. The embedded studs 109 attached to rails 104 are standard in the industry for anchoring objects such as the frame members into a hardening agent such as concrete. The support legs or U-shaped brackets 108 are also utilized, as a common method to support product, prior to encasement by a hardening agent. The brackets are attached to the rail 104 by some means such as bolts, screws or other fasteners shown at 105.

Figure 2:
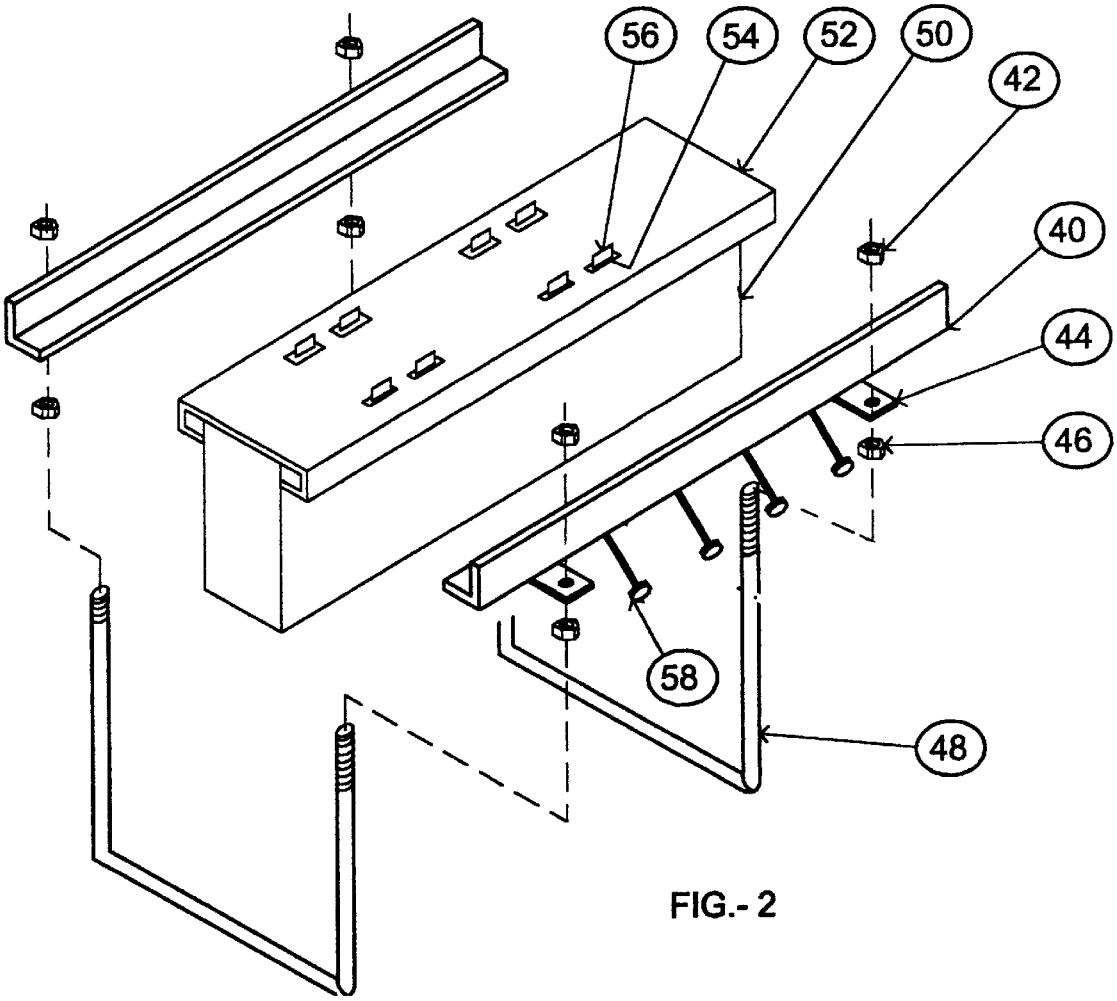
FIG. 2 is an exploded view of the trench form components in accordance with the invention.

Turning now to FIG. 2, the foldable members and associated rails and brackets, are depicted in the exploded view, completely assembled. This composition of this form is a complete departure from any current trench drain form. Items 54 and 56 are tabs and slots that lock the first foldable member 52 and 50 of the cardboard form together at multiple locations creating a strong structural void form. The rails 40 are connected to U-shaped brackets 48 and placed under flexible member 52 on its outer edge to hold the form above the trench void. This creates a void to pour a hardening agent to create a trench leaving the rails to remain in place. The rails provide seating for a trench grate or other structures.

Figure 3:
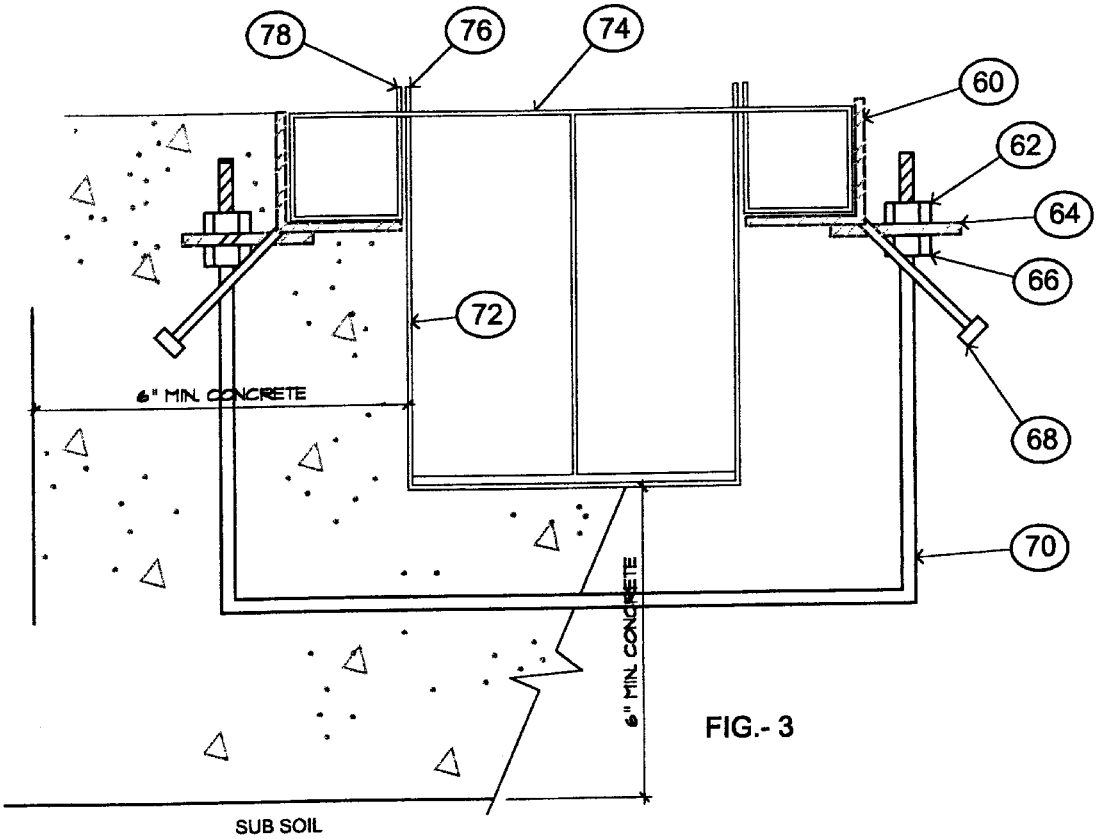
FIG. 3 is a cross sectional view of the trench form components in accordance with the invention.

Turning now to FIG. 3, you will see a structural cut depicting the foldable members, support legs, rails and the form members, with partial encasement by concrete. The embedded studs 68 provide support for rail 60 after encasement. Upon hardening of the concrete, the flexible foldable forms 72 and 74 are removed leaving a void with rails 60 embedded.

To more fully see the foldable members prior to mutual attachment, turn to FIG. 4. FIG. 4A shows bottom portion of the form 81 as an unassembled flat unit #A for storage and/or shipping purposes. You will note the dotted lines, which represent predetermined creases or scoring in the form that make assembly simple and accurate when folded, as depicted in (FIG. 4B), a cross-sectional view of the folded member 81. The trapezoidal shape of foldable member 81 when folded, creates a sloping void for water run-off. Tabs 83 and 85 folded inward and tab 87 folds over tabs 83 and 85 and downward through hole 89 at multiple locations to create the ends of the foldable member. You will note that the tabs 82 in multiple locations protrude upward, and are designed to fit through hole 84 at multiple locations of the top form when the top 86 is placed on top of the bottom form 81.

Figure 4A:
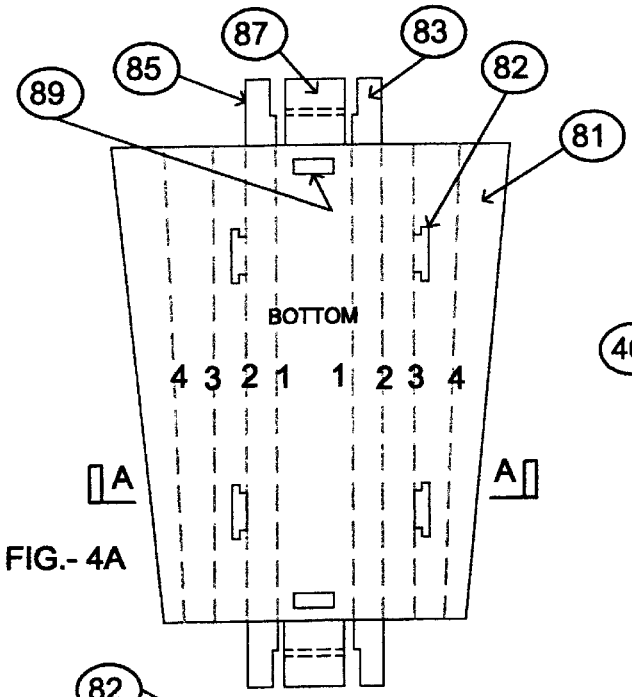
FIG. 4 (A through D) is a view of the unassembled cardboard forms in accordance with the invention.
Figure 4C:
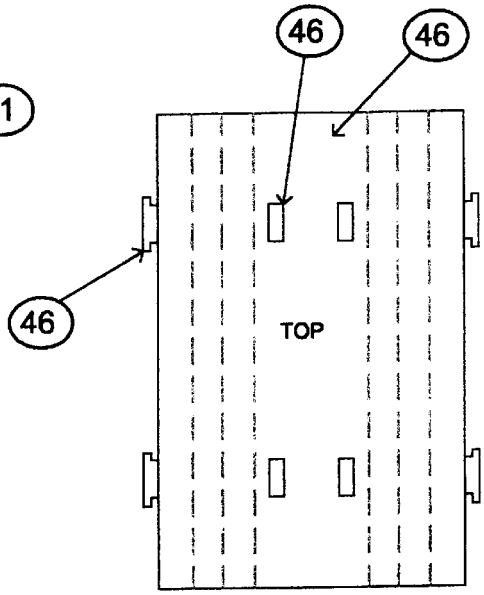
Figure 4B:
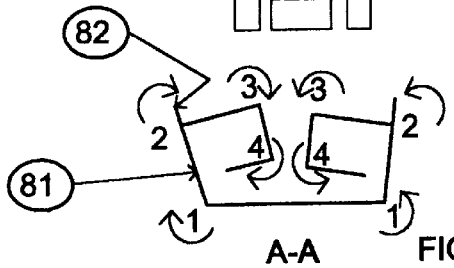
Figure 4D:
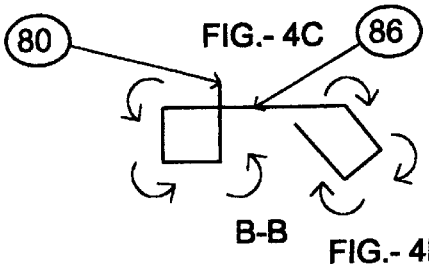

The top form 86 in FIG. 4C represents an unassembled flat unit #B for storage and/or shipping purposes. You will note the dotted lines, which represent pre-determined creases or scoring in the form that makes assembly simple and accurate when folded, as depicted in (FIG. 4D), a cross-sectional view of foldable member 86. You will note the tabs 80 at multiple locations protrude upward through 84 when the top form is folded. Once the two forms 81 and 86 are assembled together, a nail or similar object may be used to pierce the tabs 80 and 82 at a right angle to the tabs to ensure the assembly stays intact during the encasement by a hardening agent. Once the form is completely assembled with frame members and support legs, it is set into the proper location at the desired elevation, and a hardening agent can then be utilized to encase same. When the hardening agent has set up, the foldable member can be removed, leaving a trench void with an indented seat area, allowing trench covers to sit flush with the adjacent surfaces.

The forms or foldable members can be made with new cardboard with our without a deforming agent coating. The forms could also be made with recycled cardboard with or without a deforming agent coating. The foldable members may be made of any semi-rigid foldable material such as plastic, treated fiber, thin wood, etc.

Figure 5A:
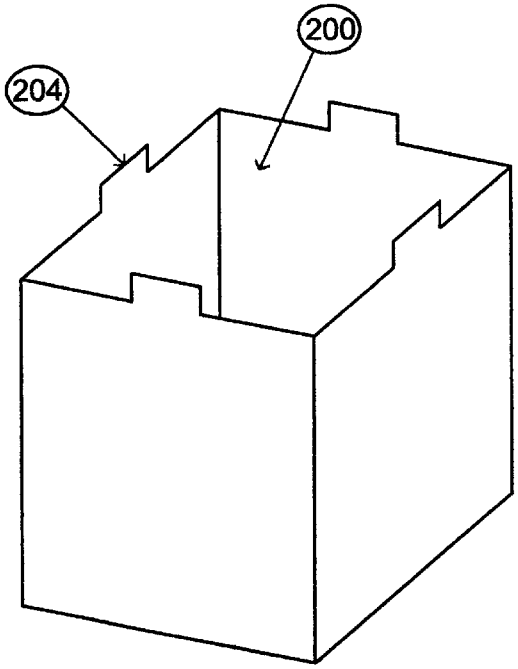
FIG. 5 (A and B) is a perspective view of the assembled cardboard forms for a catch basin in accordance with the invention.
Figure 5B:
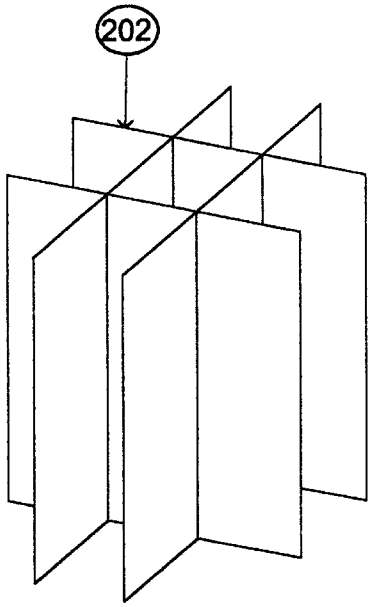

Turning now to another embodiment of the invention is FIG. 5 (*a* and *b*) which shows a view of the forms in making a catch basin void. Bottom foldable member 200 is shown in FIG. 5A with interlocking filler panels 202 shown in FIG. 5B. Detail 204 in FIG. 5A are the tabs that will serve as a guide and lock where the top cardboard form (depicted in FIG. 6, item 210) overlaps the bottom form 200.

Figure 6A:
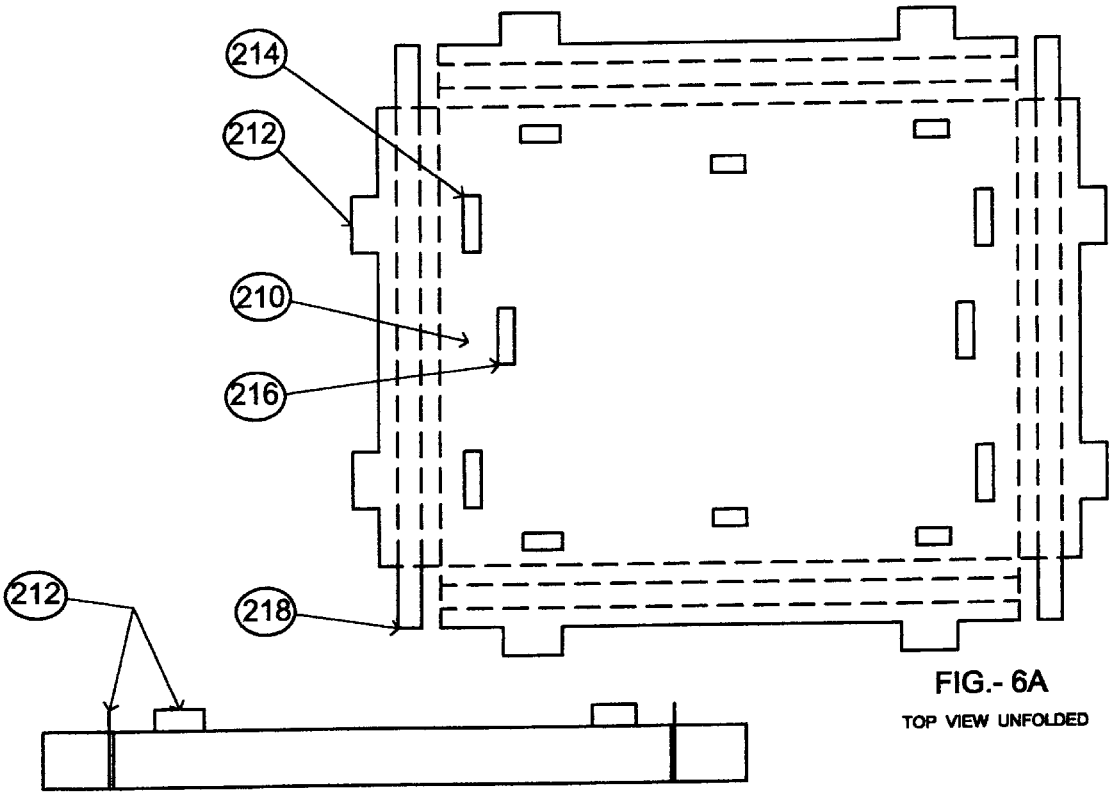
FIG. 6 (A and B) is a view of the unassembled cardboard form top, and a side view of the top assembled in accordance with the invention.

Turning to FIG. 6 (*a* and *b*), the front or top foldable member 210 is depicted unassembled during shipment and storage. You will note that the sides are prescored to make assembly easy and to exact measurements required for the rigid frame (depicted in FIG. 7, item 260). As is readily apparent, the shape of the foldable members can be of any shape and made to confine to the particular rigid frame. As the side is bent at the prescored marks, the tabs 212 will come up through part 210 through 214 pre-punched slots and lock the side into a complex shape extending out over part 200 (the bottom cardboard form).

Figure 7A:
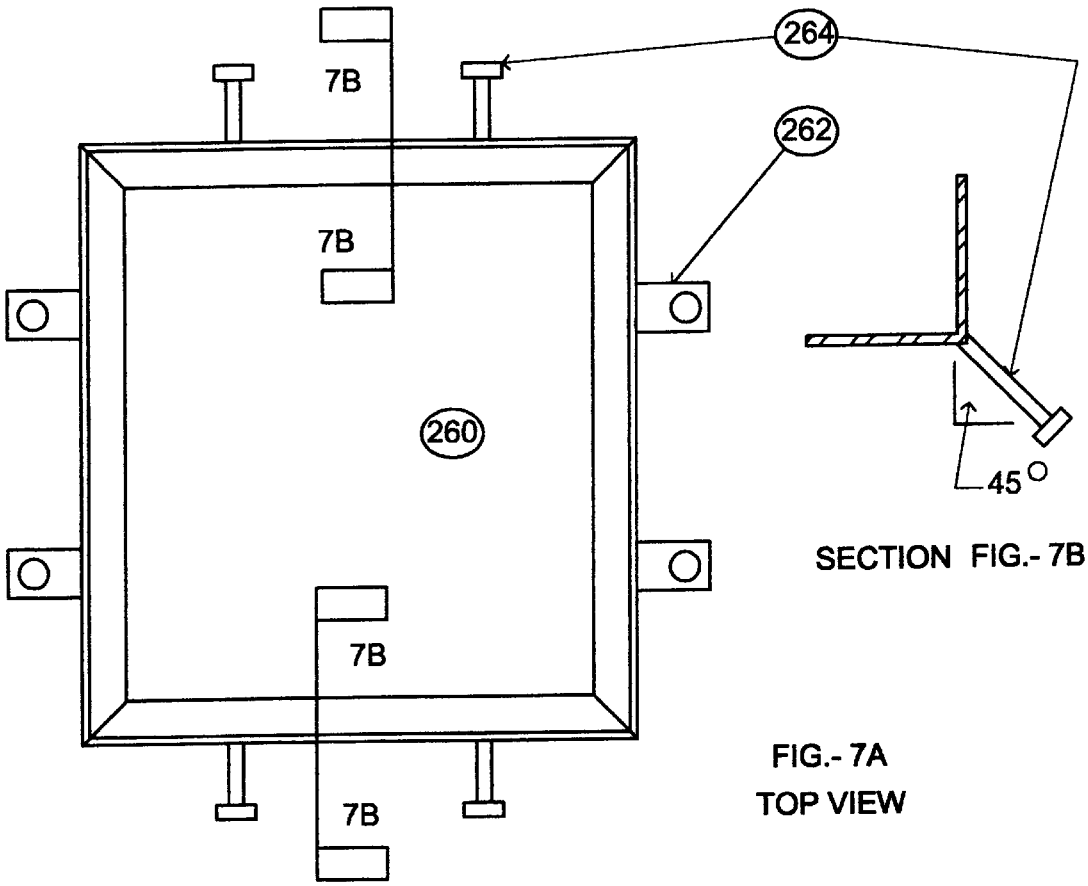
FIG. 7 (A and B) is a perspective view of the elongated frame components in accordance with the invention.

Continuing on to FIG. 7, the rigid frame 260, which will act as a grate seat after encasement, is depicted with concrete embeds 264 about its sides, which are standard in the construction industry and mounting brackets 262, whereby the support legs or U-shaped brackets can be attached. This frame will be aligned next to the edge of member 210 shown in FIG. 6. FIG. 7B depicts a cross-sectional view of the rigid frame with embedded studs in FIG. 7C shown in detail view of C-lugs 262 for connection to U-shaped brackets (not shown).

Figure 8:
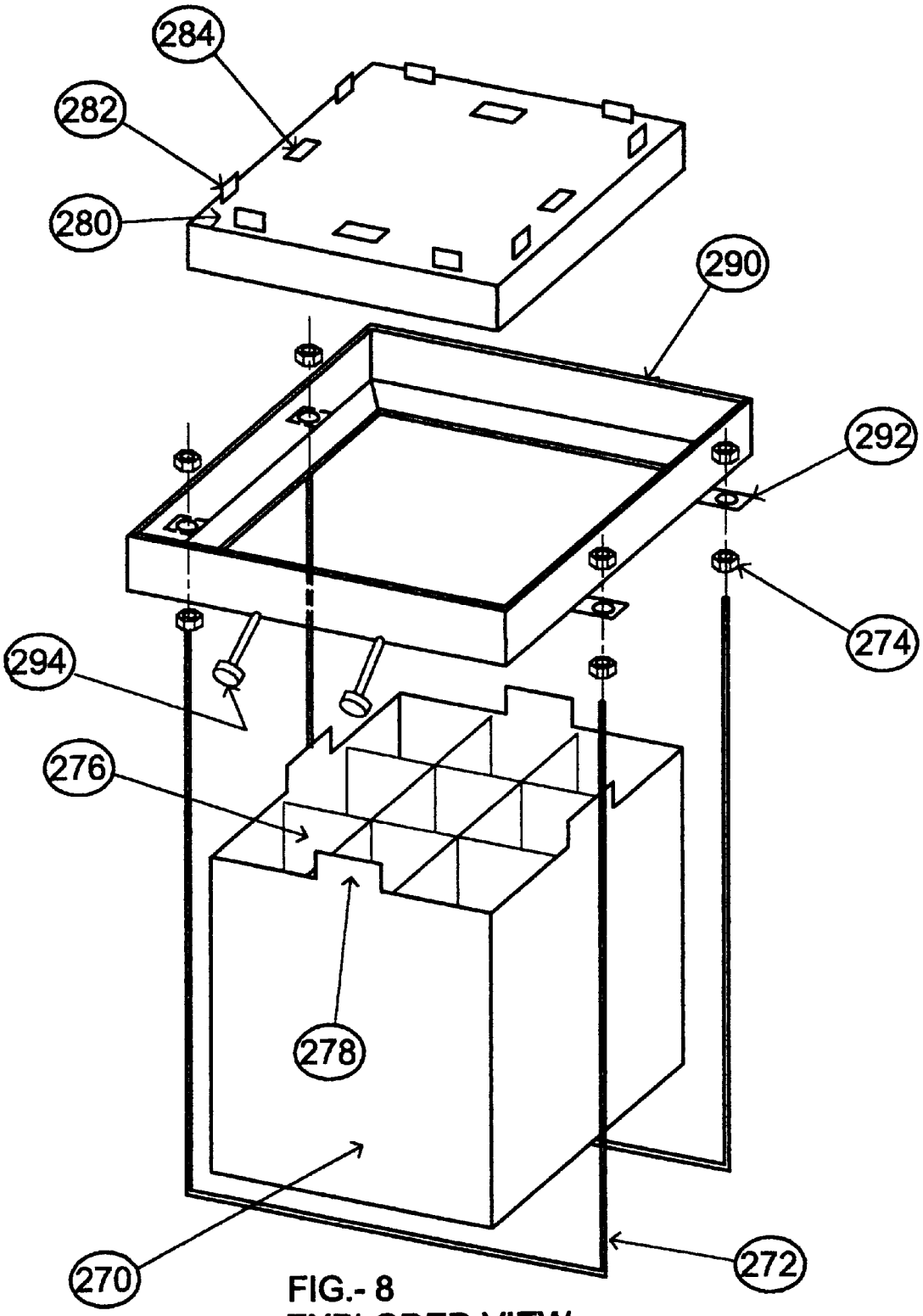
FIG. 8 is an exploded view of the components of the catch basin in accordance with the invention.

FIG. 8 shows the assembly of the parts from FIGS. 5, 6 and 7 in exploded view. It depicts the support legs or U-shaped brackets 272, which are attached to rectangular rail 290 at C-lugs 292 with fasteners 274, the intention being to support the complete form up off the ground to allow complete encasement of the forms by a hardening agent and to aid in the structural strength of the hardening agent.

Figure 9:
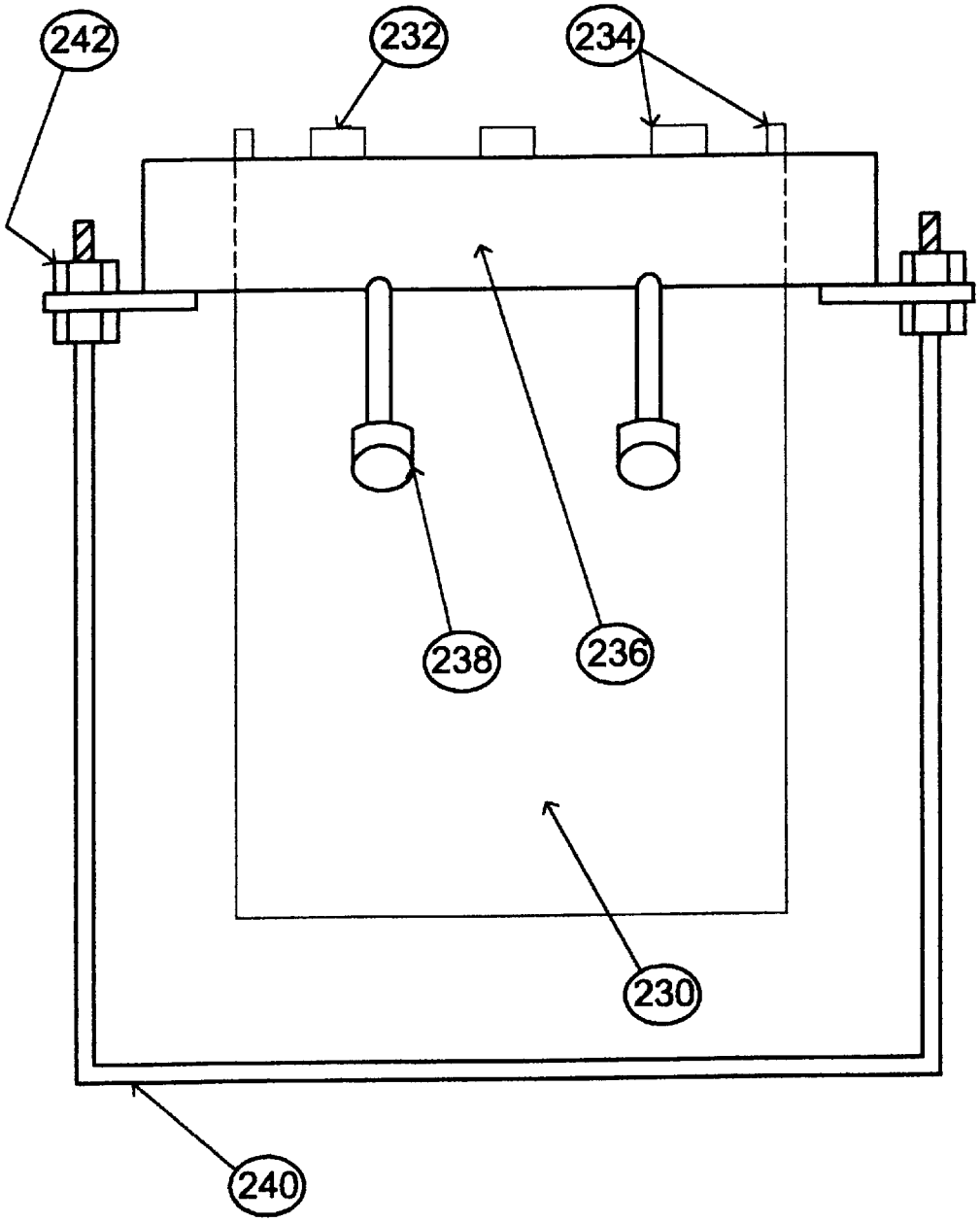
FIG. 9 is a structural side view of the cardboard and rigid form components in accordance with the invention.

FIG. 9 shows the assembled catch basin form 230 from a side structural view, ready to be set in a desired location at a specified elevation waiting for encasement by a hardening agent. Once the hardening agent has been poured and set up, the cardboard forms can then be removed and discarded, leaving a catch basin void with an indented steel seat area, allowing a grate cover to sit flush with the adjacent surfaces.

In conclusion, the form system disclosed is superior to current methods for trench voids due to its simplicity in design and assembly. It cannot only save time during installation, but it is a recyclable element that is biodegradable, thus conserving earth's resources. It is simple to deform after the hardening agent has set up, and requires simple hand tools to build. Transportation costs are lower and the invention is less likely to be damaged due to being flat while unassembled during shipment.

The indented steel seat area, rails or rectangular rail used in the invention may be any rigid material to support a drain cover or other structures. Such material may be steel or other metal or perhaps reinforced plastic.

While the invention has been described in connection with preferred embodiments, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An apparatus for forming a trench void comprising:

a first foldable member folded along pre-determined scoring into a rectangular box for insertion into a void;

a second foldable member folded along pre-determined scoring attached to said first member on top of said rectangular box;

rails placed in close proximity to said second member having attachment points for a plurality of U-shaped brackets; and a plurality of U-shaped brackets attached to said rails wherein said brackets provide support for said first and second members while placed in the void.

2. An apparatus for forming a trench void as claimed in claim 1 wherein said first member has tabs corresponding to reciprocal slots on the second member for attaching the first member to the second member.

3. An apparatus for forming a trench void as claimed in claim 1 wherein said second rails have a plurality of anchoring studs.

4. An apparatus for forming a trench void as claimed in claim 1 wherein said first and second members are made of cardboard.

5. An apparatus for forming a catch basin void comprising:

a first foldable member folded along pre-determined scoring into a rectangular box for insertion into a void;

a four-sided rail with attachment points for a plurality of U-shaped bracket placed on top of the first member that conforms substantially to the outline of the top side of the rectangular box;

a second foldable member folded along pre-determined scoring placed on top of said rail forming the sixth side of said rectangular box;

a plurality of U-shaped brackets attached to said rail wherein said brackets provide support for said first and second members while placed in the void.

6. An apparatus for forming a catch basin void as claimed in claim 5 further comprising a filler panel placed within the rectangular box.

7. An apparatus for forming a catch basin void as claimed in claim 6 wherein said filler panel is composed of interlocking pre-cut members.

8. An apparatus for forming a catch basin void as claimed in claim 7 wherein said filler panel is made of cardboard.

9. An apparatus for forming a catch basin void as claimed in claim 5 wherein said first and second members are made of cardboard.

10. An apparatus for forming a catch basin void as claimed in claim 5 wherein said first member has tabs for reciprocal attachment with the second member.

11. An apparatus for forming a catch basin void as claimed in claim 5 wherein said rail has anchoring studs.

12. An apparatus for forming a catch basin void as claimed in claim 5 wherein said second member has a plurality of insert tabs and reciprocal slots that provide structural integrity of the member.

13. A method of forming a trench void comprising:

placing into a void a first foldable member folded along pre-determined scoring into a rectangular box;

attaching a second foldable member folded along pre-determined scoring on top of said first member;

placing rails in close proximity to said second member having attachment points for a plurality of U-shaped brackets; and attaching a plurality of U-shaped brackets to said rails to provide support for said first and second members while placed in the void.

14. A method for forming a catch basin void comprising:

placing into a void a first foldable member folded along pre-determined scoring into a rectangular box;

placing on top of the first member a rail that conforms substantially to the outline of the top side of said rectangular box having attachment points for a plurality of U-shaped brackets;

attaching a second foldable member folded along pre-determined scoring on top of said rail;

attaching a plurality of U-shaped brackets to said rail wherein said brackets provide support for said first and second members while placed in the void.

* * * * *